US008745764B2

(12) United States Patent
Niemeyer

(10) Patent No.: US 8,745,764 B2
(45) Date of Patent: Jun. 10, 2014

(54) HAND SWEATBAND

(71) Applicant: Mary Catherine Niemeyer, Austin, TX (US)

(72) Inventor: Mary Catherine Niemeyer, Austin, TX (US)

( * ) Notice: Subject to any disclaimer, the term of this patent is extended or adjusted under 35 U.S.C. 154(b) by 0 days.

(21) Appl. No.: 13/674,171

(22) Filed: Nov. 12, 2012

(65) Prior Publication Data

US 2013/0145512 A1 Jun. 13, 2013

Related U.S. Application Data

(60) Provisional application No. 61/568,205, filed on Dec. 8, 2011.

(51) Int. Cl.
*A61F 9/00* (2006.01)

(52) U.S. Cl.
USPC ..... 2/16

(58) Field of Classification Search
USPC ..... 2/20, 161.1, 16, 17, 158, 159, 163
See application file for complete search history.

(56) References Cited

U.S. PATENT DOCUMENTS

| | | | | |
|---|---|---|---|---|
| 3,835,493 | A * | 9/1974 | Grivna | 441/56 |
| D278,566 | S | 4/1985 | Gustafson | |
| 4,809,366 | A | 3/1989 | Pratt | |
| 4,922,929 | A | 5/1990 | DeJournett | |
| 5,070,541 | A * | 12/1991 | Goss | 2/16 |
| 5,079,776 | A * | 1/1992 | Crawford | 2/20 |
| D360,467 | S | 7/1995 | Sydor et al. | |
| 5,592,694 | A * | 1/1997 | Yewer, Jr. | 2/161.1 |
| D389,636 | S | 1/1998 | Davis, Sr. | |
| 5,924,136 | A * | 7/1999 | Ogean | 2/159 |
| 5,928,172 | A | 7/1999 | Gaylord | |
| 6,094,747 | A * | 8/2000 | Malick | 2/159 |
| 6,341,376 | B1 * | 1/2002 | Smerdon, Jr. | 2/16 |
| D453,591 | S | 2/2002 | Garden | |
| 6,360,684 | B1 * | 3/2002 | Quaglia | 116/222 |
| D461,901 | S | 8/2002 | Rodgers | |
| 7,037,286 | B1 | 5/2006 | Reinhardt | |
| D636,883 | S | 4/2011 | Castro | |
| 2004/0031120 | A1 | 2/2004 | Cherian | |
| 2008/0306362 | A1 | 12/2008 | Davis | |
| 2011/0247125 | A1 | 10/2011 | Fournier | |

OTHER PUBLICATIONS

Niemeyer, "Wrist Sweatband" Design Filed Dec. 8, 2011, U.S. Appl. No. 29/408,180, 5 pgs.

* cited by examiner

*Primary Examiner* — Tejash Patel
(74) *Attorney, Agent, or Firm* — Egan, Peterman & Enders LLP.

(57) ABSTRACT

A sweatband for use on the hand and wrist is provided. The sweatband provides a surface on the back of a user's hand which may be utilized by a person to wipe sweat or perspiration. Thus, the back of the hand (opisthenar or dorsal surface of the hand) is used when wiping perspiration. The sweatband is constructed such that a first band portion wraps around a user's wrist and a second band portion wraps around the palm and back portion of a user's hand. In one embodiment the sweatband may be constructed of an elongated piece of material that is looped to form the first and second band portions. In one embodiment, a sweatband is interchangeable for use with the left or right hand. In one embodiment the sweatband is reversible.

22 Claims, 6 Drawing Sheets

HAND SWEATBAND

This application claims the benefit of U.S. Provisional Patent Application No. 61/568,205, filed on Dec. 8, 2011 and entitled "Wrist Sweatband", which is hereby incorporated herein by reference in its entirety for all purposes.

TECHNICAL FIELD OF THE INVENTION

This application relates to sweatbands and more particularly to hand and wrist sweatbands.

BACKGROUND

Sweatbands are commonly used to absorb and collect sweat/perspiration created from physical exertion. Often persons wear sweatbands during athletic events and workouts. For example, wrist sweatbands and head sweatbands are well known. Wrist sweatbands may collect perspiration from the arms and wrist regions. In addition, users may use wrist sweatbands to wipe perspiration from other areas of the body such as the forehead and face. Anatomically, it can be somewhat awkward to use the wrist area to wipe perspiration. In addition, the surface area of a wrist sweatband is typically somewhat limited.

In one prior art wrist sweatband disclosure, U.S. Pat. No. 4,809,366, it is shown to incorporate a pad on the back the user's hand with the wrist sweatband. Such a configuration allows the back of the hand to be utilized to wipe perspiration, addressing some of the deficiencies of wrist sweatbands as described above. However, the sweatband of U.S. Pat. No. 4,809,366 is unnecessarily complex and does not provide a desirable user experience.

It is desirable to provide an improved sweatband for advantageously utilizing the back of the hand as a region to wipe perspiration.

SUMMARY OF THE INVENTION

A sweatband for use on the hand and wrist area is provided. The sweatband provides a surface on the back of a user's hand and/or on the palm of the hand which may be utilized by a person to wipe sweat or perspiration. Thus, the back of the hand (opisthenar or dorsal surface of the hand) may be used when wiping perspiration. In addition, the palm surface of the hand may be used when wiping perspiration. The sweatband is constructed such that a first band portion wraps around a user's wrist and a second band portion wraps around the palm and back portion of a user's hand. In one embodiment, the sweatband may be constructed of an elongated piece of material that has its ends looped and attached to a mid-portion to form the first and second band portions. In one embodiment, the sweatband is reversible. In one embodiment, the sweatband is interchangeable for use with the left or right hand.

In another embodiment, a hand sweatband is provided. The sweatband may include a wrist opening on a first end of the hand sweatband, the wrist opening configured such that the wrist opening may be secured to a user's wrist; a finger opening on a second end of the hand sweatband, the finger opening configured such that the finger opening edges may wrap around the back and palm of the user's hand such that the hand sweatband covers at least a portion of the back of the user's hand and a portion of the user's palm; and a thumb opening, the thumb opening being located between the first end and second end, the thumb opening configured to allow extension of the user's thumb through the thumb opening.

In another embodiment, a sweatband may comprise a unitary piece which forms the sweatband. The unitary piece may comprise a first loop region which forms boundaries of a wrist opening, a second loop region which forms boundaries of a finger opening. A third opening is formed by the first loop region and the second loop region to provide a thumb opening.

In yet another embodiment, a method of forming a sweatband is provided. The method may include providing an elongated piece of material having a first end, second end, first elongated side and second elongated side. The method further includes looping the first end of the elongated piece of material and attaching the first end of the elongated piece of material to the elongated piece of material to form a first opening; and looping the second end of the elongated piece of material and attaching the second end of the elongated piece of material to the elongated piece of material to form a second opening. The method further includes the first end and the second end of the elongated piece of material being attached to the elongated piece of material in a manner that provides a third opening between the first opening and the second opening. In one embodiment, the first and second ends of the elongated piece of material are attached together.

DETAILED DESCRIPTION OF THE INVENTION

As disclosed herein, an improved hand and/or wrist sweatband is provided. The sweatband provides a surface on the back of a user's hand and/or on the palm of the hand which may be utilized by a person to wipe sweat or perspiration. Thus, the back of the hand (opisthenar or dorsal surface of the hand) may be used when wiping perspiration. In addition, the palm surface of the hand may be used when wiping perspiration. The sweatband is constructed such that a first band portion wraps around a user's wrist and a second band portion wraps around the palm and back portion of a user's hand. In one embodiment, the sweatband may be constructed of an elongated piece of material that has its ends looped and attached to a mid-portion to form the first and second band portions. In one embodiment, the sweatband is reversible. In one embodiment, the sweatband is interchangeable for use with the left or right hand.

Figure 1:
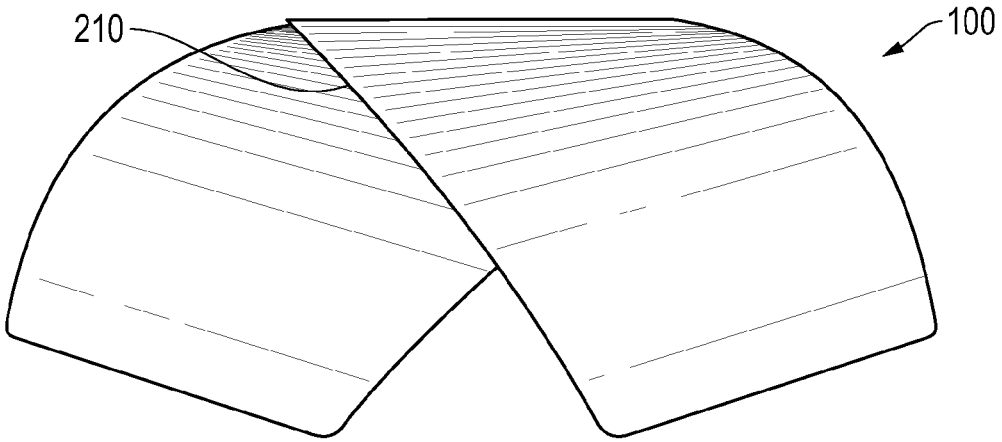
FIG. 1 is an illustration of a first side of one embodiment of a hand sweatband.
Figure 2:
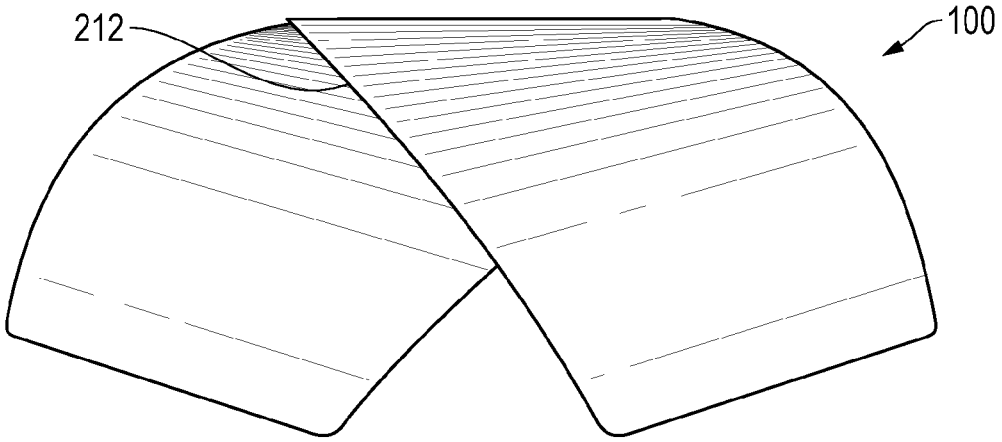
FIG. 2 is an illustration of a second side of one embodiment of a hand sweatband.
Figure 3:
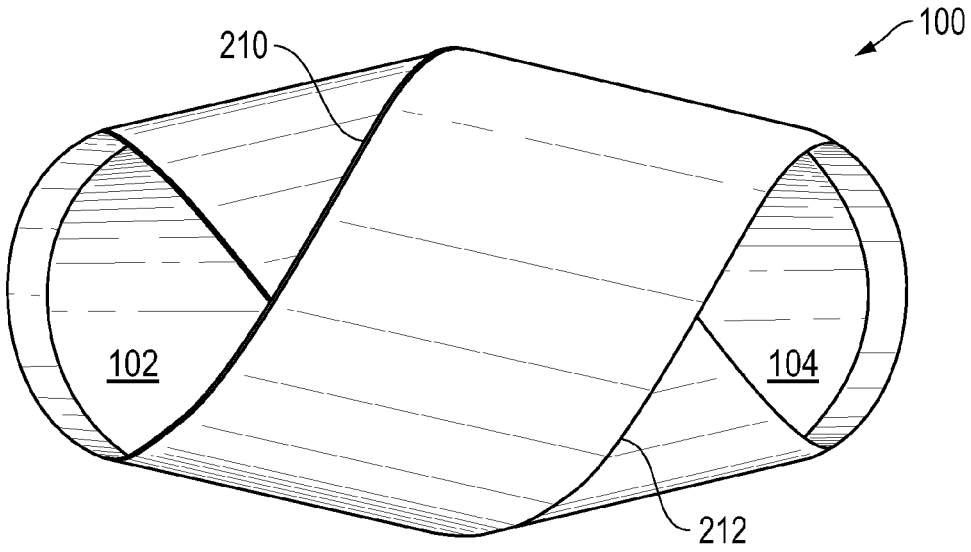
FIG. 3 is an illustration of a bottom side of one embodiment of a hand sweatband.
Figure 4:
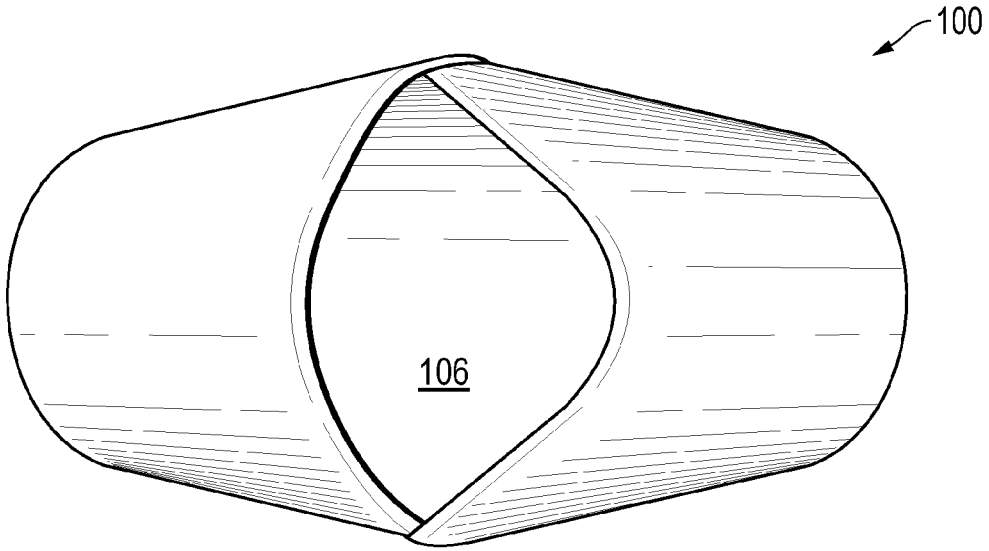
FIG. 4 is an illustration of a top side of one embodiment of a hand sweatband
Figure 5:
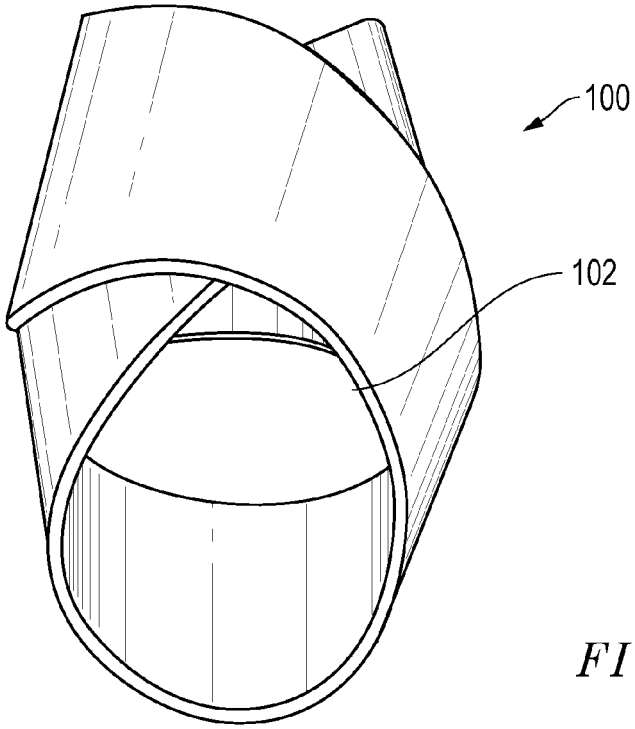
FIG. 5 is a perspective view of a first end of one embodiment of a hand sweatband
Figure 6:
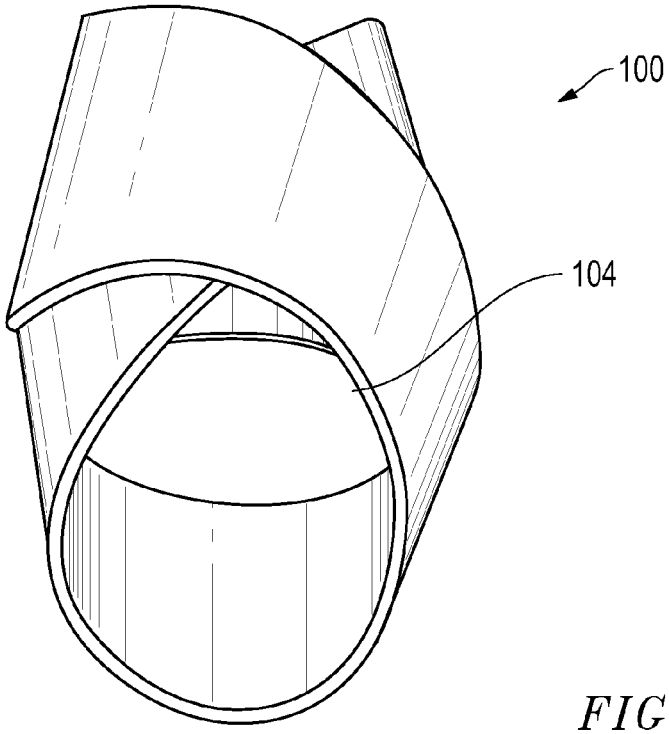
FIG. 6 is a perspective view of a second end of one embodiment of a hand sweatband.
Figure 7:
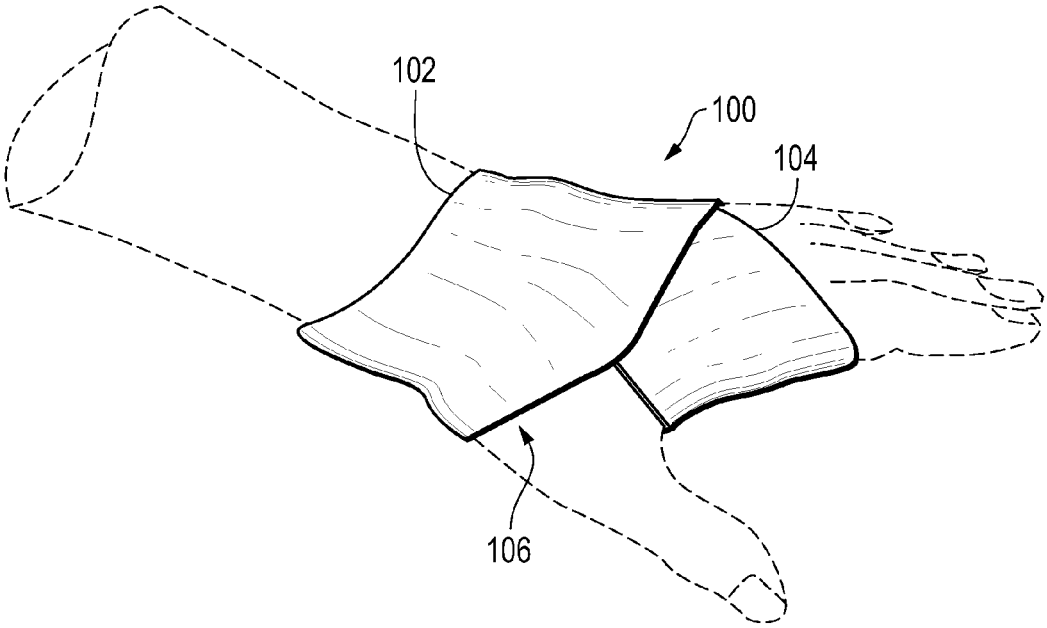
FIG. 7 is a perspective view of a hand sweatband on a hand showing the backside (opisthenar or dorsal surface of the hand) covered by the sweatband.
Figure 8:
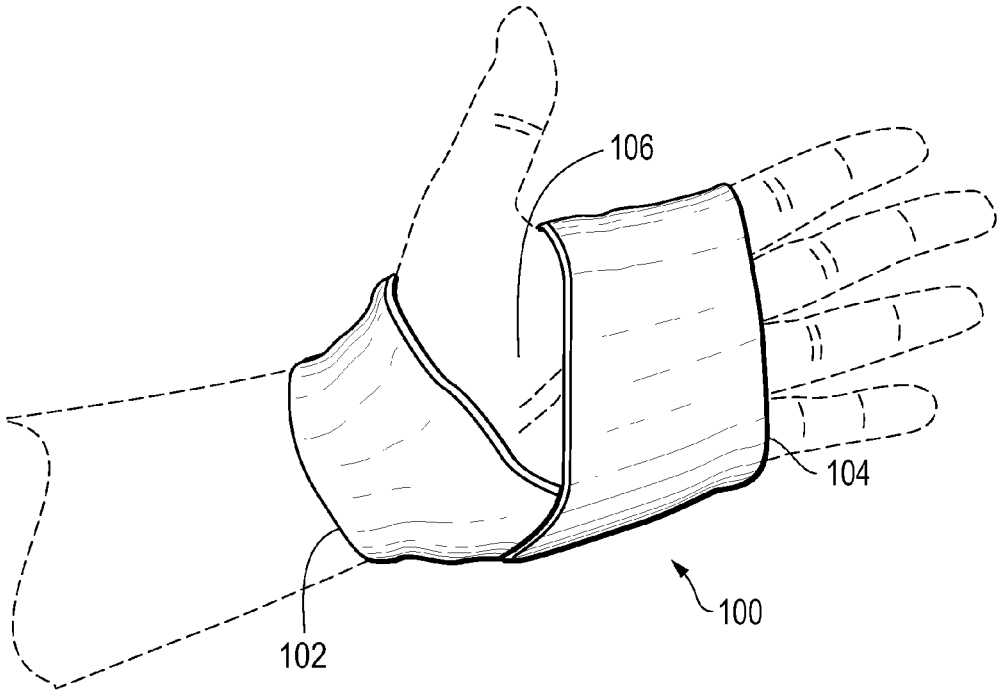
FIG. 8 is a perspective view of a hand sweatband on a hand showing the palm of the hand covered by the sweatband.

FIGS. 1-6 illustrate one exemplary embodiment of a hand sweatband. More particularly, a wrist sweatband 100 is shown from a first side in FIG. 1 and an opposing second side in FIG. 2. FIGS. 3 and 4 illustrate bottom and top views of the hand sweatband 100. FIGS. 5 and 6 illustrate first and second end views of the hand sweatband 100. FIGS. 7 and 8 illustrate the placement on the hand sweatband 100 on a user's hand, with FIG. 7 illustrating the placement on the back of a user's hand and FIG. 8 illustrating the placement on the palm of a user's hand.

As shown in FIGS. 3-8, the hand sweatband may comprise three openings. A first opening 102 is provided through which a user's wrist may extend. As shown, the edges which form the first opening connect together to form the opening in a manner that secures the hand sweatband around the wrist. A second opening 104 is provided through which a user's index, middle, ring and little finger may extend. As shown, the edges which form the second opening connect together to form the opening in a manner that secures the hand sweatband around the back of the hand and palm. A third opening 106 is provided through which a user's thumb finger may extend. As shown, the edges which form the third opening connect together to form the opening in a manner that secures the base of the thumb. As shown in the figures, the hand sweatband conveniently wraps around the wrist and also wraps around the user's palm and back of the hand. In this manner, the hand sweatband is secured in place and will provide ample surface area on the back of the hand and the palm of the hand to use to wipe sweat or perspiration in an anatomically easy fashion. Thus, as shown in the figures the hand sweatband loops around the wrist and the back/palm of the hand.

The hand sweatband may be made from any of a wide range of materials or combinations thereof, such as cloth, knitted materials, perspiration wicking materials, cottons, terry cloth, stretched knits, polyesters, spandex, Lycra, water absorbents, etc. In one embodiment, the hand sweatband may be made from a wicking material comprised of cotton, polyester and Lycra. It will be recognized that many different materials and combinations of materials may be utilized and that the concepts disclosed herein are not limited to a particular material. The hand sweatband may be made of a material that stretches so that as a user pulls it over the hand the hand sweatband will stretch around the wider parts of the hand and then tighten around the wrist and back/palm of the hand. In this manner the hand sweatband may be secured to a user yet easy to take on and off.

The hand sweatband of FIGS. 1-8 is conveniently configured in a symmetrical manner such that the same hand sweatband may be utilized for both the right and left hand. Thus, the configuration allows the opening 106 to be utilized for extension through of either the right or left thumb. Such a configuration allows a single sweatband to be utilized for either hand without the need for matching pairs of sweatbands. The hand sweatband may also be then sold in single units without the need of selecting a right or left hand model.

The hand sweatband of FIGS. 1-8 is also conveniently configured in a manner that the hand sweatband may be turned inside out and used. Thus, the hand sweatband is reversible. A reversible sweatband allows different colors are patterns to be provided in a single sweatband so that a user may turn the band inside out to select the desired color or pattern. The design of the hand sweatband provided herein is thus highly convenient in that the same hand sweatband may be used on either hand and/or may be turned inside out. Thus, in one exemplary embodiment each hand sweatband may have four uses right hand or left hand and original side or reversed side for each hand.

For one reversible embodiment, the hand sweatband may be comprised of two different pieces stitched or attached together on the edges to form a double layered hand sweatband. Each of the layers may have its own color or pattern, thus providing a different appearance when reversed. In another reversible embodiment, the hand sweatband may be a single layer material in which each side of the material has a different color or pattern to thus provide the different appearance when reversed.

Figure 9:
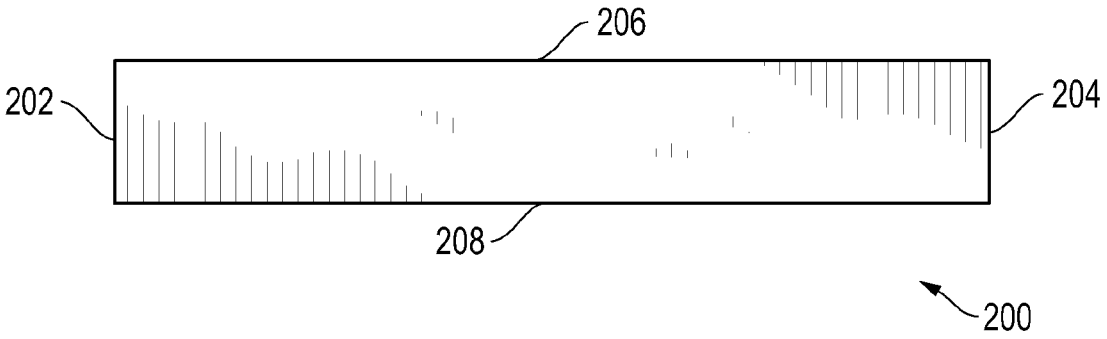
FIG. 9 is an illustration of one embodiment of a piece of material that may be utilized to form the hand sweatband illustrated in FIGS. 1-9.
Figure 10:
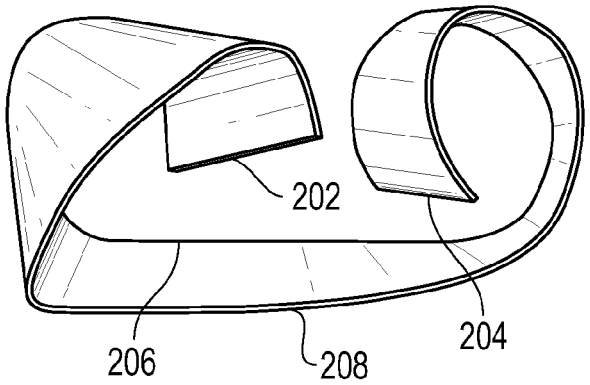
FIG. 10 is an illustration of one embodiment of a method to form the hand sweatband from the piece shown in FIG. 9.

The configuration of the hand sweatband shown in FIGS. 1-8 is also advantageous in that one exemplary embodiment may be made from a unitary elongated piece of material thus providing a desirable ease of manufacturing. For example as shown in FIG. 9, an elongated piece of material 200 is provided having shorter sides 202 and 204 and longer sides 206 and 208. In order to form the hand sweatband of FIGS. 1-8, the sides 202 and 204 may curled up as shown in FIG. 10. The sides may then be attached (not shown in FIG. 10) such that side 202 is attached to side 206 to form a first joinder location 210 and side 202 is attached to form a second joinder location 212. The sides may be attached by standard material stitching, fabric glues, or any other joinder technique. The joinder locations 210 and 212 may be seen in an attached configuration in FIGS. 1-3 thus forming a somewhat figure eight like loop pattern to create the final hand sweatband as shown in the figures. In particular, looping the two ends and attaching to opposing sides of the elongated material creates three openings, one for the wrist, one for the four fingers and one for the thumb. In this highly efficient manner a hand sweatband may be easily made from a unitary elongated piece of material to form a hand sweatband that provides a large and anatomically easy wiping surface(s), that is usable on either hand and that is reversible. Thus, the sweatband has an ease and elegance of manufacturing while providing the advantageous user features described herein.

Figure 11:
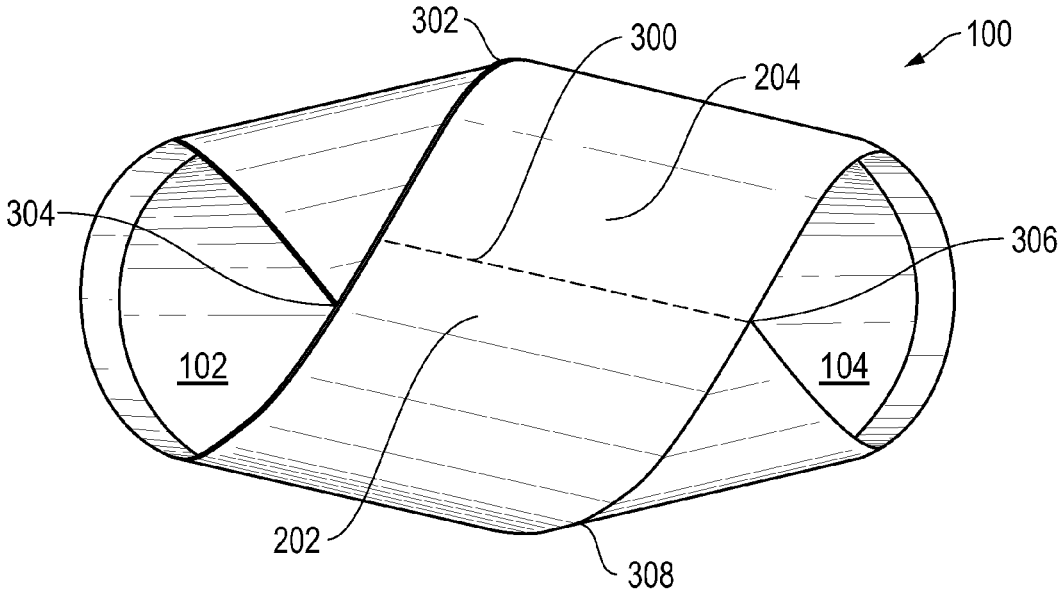
FIG. 11 is an illustration of one embodiment of a method to form the hand sweatband from the piece shown in FIG. 9.

FIG. 11 illustrates an alternative manner of forming the hand sweatband utilizing the elongated material 200 shown in FIG. 9. As shown in FIG. 11, the two ends 202 and 204 may joined together at location 300 such as via stitching or any other joinder technique. To further secure the hand sweatband in place, the overlapping portions of the looped elongated material 200 may be additionally stitched together along the edges of elongated material 200 at the locations between points 302 and 304 and also stitched together at the locations between points 306 and 308. In this manner the elongated piece 200 is utilized to form the hand sweatband 100. It will be recognized that the methods of forming the hand sweatband as shown in FIGS. 10 and 11 are exemplary and other methods of forming the hand sweatband from a single elongated piece of material may be utilized. Further, it will be recognized that the hand sweatbands described herein need not be formed from a starting piece of material as shown in FIG. 9 and other techniques may be utilized to obtain the beneficial hand sweatband structure described herein.

Figure 12:
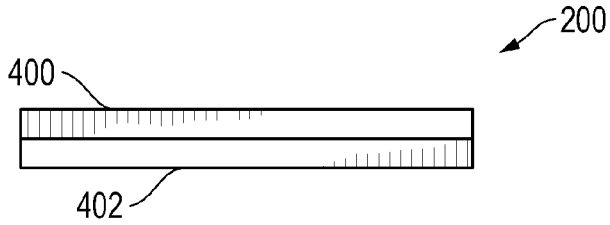
FIGS. 12 and 13 illustrate exemplary embodiments of the use of multiple layers to form a unitary piece of material.
Figure 13:
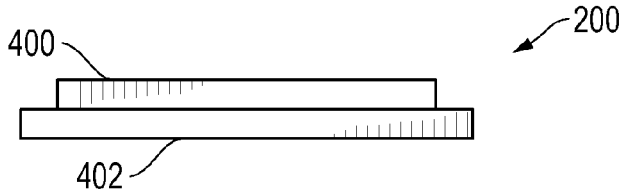

As described herein the elongated piece 200 may be one unitary piece. It will be recognized that multiple layers of material may be joined together (for example stitched at the edges) so that the single unitary piece of material may be comprised of multiple layers. Thus, as used herein a unitary piece may be comprised of multiple layers of material attached together. Thus, the reversible embodiment described above with regard to two layers may still be construed as a unitary piece of material as the layers have been joined together. Thus for example, as shown in the cross section of elongated piece 200 illustrated in FIG. 12, the elongated material may be comprised of a first layer 400 and a second layer 402. An alternative arrangement of layers 400 and 402 is shown in FIG. 13. In one embodiment, the layers 400 and 402 may be joined by stitching together the ends of the layers, though it will be recognized that alternative techniques may be utilized to form a unitary elongated piece 200 from multiple layers of material.

In one illustrative embodiment, the size of the elongated piece 200 may be varied so as to create different sizes of the hand sweatband. Thus, for example, a larger piece 200 may be used for a men's hand sweatband and a smaller piece 200 may be used for a women's sweatband.

In one illustrative embodiment formed according to the embodiment of FIG. 10, smaller hand sweatbands may have ends 202 and 204 approximately 2.5 inches in dimension and sides 206 and 208 approximately 15 inches in dimension while larger hand sweatbands may have ends 202 and 204 approximately 2.5 inches in dimension and sides 206 and 208 approximately 18 inches in dimension. The joinder locations 206 and 208 may be adjusted so that that the openings 102 and 104 vary in size. In one embodiment, the wrist opening may be of slightly smaller dimensions than the opening that the fingers extend through. In one embodiment, the joinder location 210 of a 15 inch side 206 may be centered at approximately 9 inches from end 202 (and more generally ranging from 8 to 10 inches) and the joinder location 212 of the 19 inch side 208 may be centered at approximately six inches (and more generally ranging from 5 to 7 inches) from the end 202.

In one illustrative embodiment formed according to the embodiment of FIG. 11, the hand sweatbands may have ends 202 and 204 approximately 2.50 to 3.5 inches in dimension and sides 206 and 208 approximately 15 to 17.75 inches in dimension. Smaller hand sweatbands (size extra-small and/or "skinny" hand sweatbands) can be made utilizing the lower end of the range of dimensions where larger hand sweatbands (for example all the way to size extra-large) can be made utilizing the upper end of the range of dimensions. It will be recognized by those in the art that the particular dimensions chosen may be a matter of design choice and other dimensions may be utilized.

In one illustrative embodiment, the hand sweatband may be made of multiple materials. For example, the exposed layer of a multiple layer embodiment of the hand sweatband on the back of the hand and/or palm may be made of a material that is more highly sweat absorbent. Such a configuration may aid in the wiping of sweat from a user, such as wiping a user's face or forehead. In another embodiment, the regions used for wiping sweat may be comprised of a material that is more highly sweat absorbent while other regions of the hand sweatband may be made of a differing material.

Though FIGS. 9-11 illustrate exemplary methods of forming the hand sweatband of FIGS. 1-8, the hand sweatband disclosed herein is not limited to such methods of forming the sweatband. Other techniques for manufacturing the sweatband may be utilized while still gaining the benefit of the hand sweatband disclosed herein. For example, rather than using an elongated piece of material that is looped and then joined at the side or at the ends, a machine woven technique may be utilized to directly form the hand sweatband as described so that the hand sweatband is woven as one piece without the need for the end joinder technique described in FIGS. 9-11.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and structures. For example, equivalent elements may be substituted for those illustrated and described herein and certain features of the invention may be utilized independently of the use of other features, all as would be apparent to one skilled in the art after having the benefit of this description of the invention.

The invention claimed is:

1. A hand sweatband comprising:

a wrist opening on a first end of the hand sweatband, the wrist opening configured such that the wrist opening may be secured to a user's wrist;

a finger opening on a second end of the hand sweatband, the finger opening configured such that finger opening edges may wrap around a back and palm of the user's hand such that the hand sweatband covers at least a portion of the back of the user's hand and a portion of the user's palm, the finger opening completely encircling both the back of the user's hand and the palm of the user's hand; and a thumb opening, the thumb opening being located between the first end and second end, the thumb opening configured to allow extension of the user's thumb through the thumb opening, the thumb opening forming a first open region that is isolated by a portion of the hand sweatband from a second open region, the second open region formed by the finger opening.

2. The hand sweatband of claim 1, the hand sweatband configured such that it fits both a left hand and right hand of the user.

3. The hand sweatband of claim 2, the hand sweatband being reversible.

4. The hand sweatband of claim 1, the hand sweatband being reversible.

5. The hand sweatband of claim 1, the wrist opening having wrist opening edges secured together to form boundaries of the wrist opening and the finger opening having finger opening edges secured together to form boundaries of the finger opening.

6. A hand sweatband comprising:

a wrist opening on a first end of the hand sweatband, the wrist opening configured such that the wrist opening may be secured to a user's wrist;

a finger opening on a second end of the hand sweatband, the finger opening configured such that finger opening edges may wrap around a back and palm of the user's hand such that the hand sweatband covers at least a portion of the back of the user's hand and a portion of the user's palm; and a thumb opening, the thumb opening being located between the first end and second end, the thumb opening configured to allow extension of the user's thumb through the thumb opening, wherein the wrist opening formed by a first loop region and the finger opening formed by a second loop region, the first loop region and the second loop region together forming the thumb opening.

7. The hand sweatband of claim 6, the hand sweatband being configured such that it fits both a left hand and a right hand of the user.

8. The hand sweatband of claim 6, a first side of the first loop region forming the wrist opening and a first side of the second loop region forming the finger opening, the thumb opening formed by a second side of the first loop region and a second side of the second loop region.

9. The hand sweatband of claim 8, the hand sweatband being configured such that it fits both a left hand and a right hand of the user.

10. A sweatband comprising:

a unitary piece which forms the sweatband, the unitary piece comprising:

a first loop region which forms boundaries of a wrist opening, and a second loop region which forms boundaries of a finger opening; and a third opening formed by the first loop region and the second loop region to provide a thumb opening.

11. The sweatband of claim 10 wherein the unitary piece is formed of at least two layers.

12. The sweatband of claim 11, wherein the unitary piece is formed of a first layer of material and a second layer of material, the first and second layers being different in size or composition.

13. The sweatband of claim 10, the unitary piece being an elongated piece that is joined together to form the first loop region and the second loop region.

14. The sweatband of claim 13, a first and second end of the elongated piece being joined to another portion of the unitary piece.

15. The sweatband of claim 14, the first and second ends of the elongated piece being joined to each other.

16. The sweatband of claim 10, the sweatband being configured such that it fits both a left hand or a right hand of the user.

17. A method of forming a hand sweatband, comprising:

providing an elongated piece of material having a first end, second end, first elongated side and second elongated side;

looping the first end of the elongated piece of material and attaching the first end of the elongated piece of material to the elongated piece of material to form a first opening; and looping the second end of the elongated piece of material and attaching the second end of the elongated piece of material to the elongated piece of material to form a second opening;

wherein the first end and the second end of the elongated piece of material are attached to the elongated piece of material in a manner that provides a third opening between the first opening and the second opening.

18. The method of claim 17, wherein the first opening is a wrist opening, the second opening is a finger opening and the third opening is a thumb opening.

19. The method of claim 18, wherein the elongated piece of material is a unitary piece.

20. The method of claim 18, wherein the hand sweatband is configured to be interchangeable between a user's left and right hand.

21. The method of claim 18, wherein the first and second ends of the elongated piece of material are attached together.

22. The method of claim 18, wherein the first end of the elongated piece of material is attached to a first side of the elongated piece of material and the second end of the elongated piece of material is attached to a second side of the elongated piece of material.

* * * * *